US005114435A

United States Patent [19]

Abramo et al.

[11] Patent Number: 5,114,435

[45] Date of Patent: May 19, 1992

[54] POLYALKYLENE SUCCINIMIDE DEPOSIT CONTROL ADDITIVES AND FUEL COMPOSITIONS CONTAINING SAME

[75] Inventors: Guy P. Abramo, Sewell; Jeffrey C. Trewella, Flemington, both of N.J.

[73] Assignee: Mobil Oil Corporation, Fairfax, Va.

[21] Appl. No.: 481,938

[22] Filed: Feb. 20, 1990

Related U.S. Application Data

[63] Continuation-in-part of Ser. No. 292,139, Dec. 30, 1988, abandoned.

[51] Int. Cl.[5] ..... C10L 1/18; C10L 1/22

[52] U.S. Cl. ..... 44/348; 44/347; 44/459

[58] Field of Search ..... 44/71, 57, 63, 348, 44/347, 459

[56] References Cited

U.S. PATENT DOCUMENTS

| | | | |
|---|---|---|---|
| 3,219,666 | 11/1965 | Norman et al. | 252/51.5 R |
| 3,445,386 | 5/1969 | Otto et al. | 252/32.7 |
| 3,490,882 | 1/1970 | Dunworth | 44/73 |
| 3,497,334 | 2/1970 | Gee et al. | 44/71 |
| 3,511,780 | 5/1970 | Neblett et al. | 252/32.7 |
| 3,717,446 | 2/1973 | Howland et al. | 44/58 |
| 3,920,698 | 11/1975 | Haemmerle et al. | 44/63 |
| 4,022,589 | 5/1977 | Alquist et al. | 44/58 |
| 4,173,456 | 11/1979 | Scheule et al. | 44/62 |
| 4,240,803 | 12/1980 | Andress, Jr. | 44/63 |
| 4,325,708 | 4/1982 | Bagnetto | 44/58 |
| 4,325,827 | 4/1982 | Papay et al. | 252/51.5 A |
| 4,482,357 | 11/1984 | Hanlon | 44/63 |

FOREIGN PATENT DOCUMENTS

| | | |
|---|---|---|
| 419690 | 12/1934 | United Kingdom . |
| 1486144 | 9/1977 | United Kingdom . |

OTHER PUBLICATIONS

Smalheer and Smith, "Lubricant Additives", 1967, pp. 1-11.

*Primary Examiner*—Prince Willis, Jr.
*Assistant Examiner*—Ellen McAvoy
*Attorney, Agent, or Firm*—Alexander J. McKillop; Charles J. Speciale; Michael J. Mlotkowski

[57] ABSTRACT

Deposits on intake valves in gasoline internal combustion engines are reduced by an additive for fuel compositions comprising a mixture of (1) a polyalkylene succinimide, (2) a polyalkylene and (3) a mineral oil. The invention also comprises a fuel composition made up of a major amount of liquid hydrocarbon fuel such as gasoline or diesel and a minor amount of the aforesaid mixture. In still another aspect the invention comprises a method for removing and/or preventing engine deposits which adversely affect the performance of gasoline powered engines by running the engine with a fuel containing an effective amount of the previously described mixture.

16 Claims, No Drawings

POLYALKYLENE SUCCINIMIDE DEPOSIT CONTROL ADDITIVES AND FUEL COMPOSITIONS CONTAINING SAME

RELATED APPLICATIONS

This application is a continuation-in-part of copending application Ser. No. 292,139, filed on Dec. 30, 1988 now abandoned.

NATURE OF THE INVENTION

This invention relates to additives for controlling or preventing engine deposits and to fuel compositions containing these additives.

BACKGROUND OF THE INVENTION

Hydrocarbyl succinimides, such as those derived from poly-alkylene polyamines, are known materials which have been widely used as fuel detergents. For example, U.S. Pat. No. 4,240,803, which is incorporated herein by reference, describes the use of alkenyl succinimides in gasoline to reduce engine deposits. U.S. Pat. No. 4,482,357, which is also incorporated by reference, discloses additive mixtures for diesel fuels which include a hydrocarbyl succinimide or succinamide and the reduction of coke deposition by the use of these additive mixtures.

An object of this invention is to provide an additive for fuel compositions which will contribute to and promote both valve and carburetor cleanliness.

SUMMARY OF THE INVENTION

Briefly stated this invention comprises in one aspect an additive for fuel compositions comprising a mixture of (1) a polyalkylene succinimide, (2) a liquid polyalkylene and (3) a mineral oil. In another aspect this invention comprises a fuel composition made up of a major amount of gasoline or diesel fuel and a minor amount of the aforesaid mixture. In still another aspect this invention comprises a method for removing and/or preventing engine deposits which can adversely affect the performance of gasoline- or diesel-powered engines by running the engine with a fuel containing an effective amount of the previously described mixture.

DETAILED DESCRIPTION OF THE INVENTION

The polyalkylenesuccinimide utilized to make the additive composition of this invention is prepared by reacting a polyalkylenesuccinic acid or anhydride, wherein the polyalkylene is derived from a $C_2$, $C_3$, or $C_4$ olefin, or mixtures thereof, with a polyalkylene polyamine of the formula $$NH_2-(RNH)_n-R-NH_2$$

in which R is an alkylene radical having from 1 to 5 carbon atoms and "n" is from 0 to 10.

The polyalkylenesuccinic anhydride can be made in accordance with a prior art process involving the thermal condensation of a polyalkylene or polyalkylene mixture with maleic anhydride. This is conveniently carried out at from about 150° C. to about 250° C., preferably about 175° C. to 225° C.

Particularly preferred is the succinic acid or anhydride derived from a polyalkylene such as isobutylene. Suitable polyamines include methylene diamine, ethylene diamine, diethylene triamine, dipropylene triamine, triethylene tetramine, tetraethylene pentamine, pentamethylene hexamine, hexaethylene heptamine, undecaethylene dodecamine, and the like.

One series of reactions, showing one possible product, is as follows:

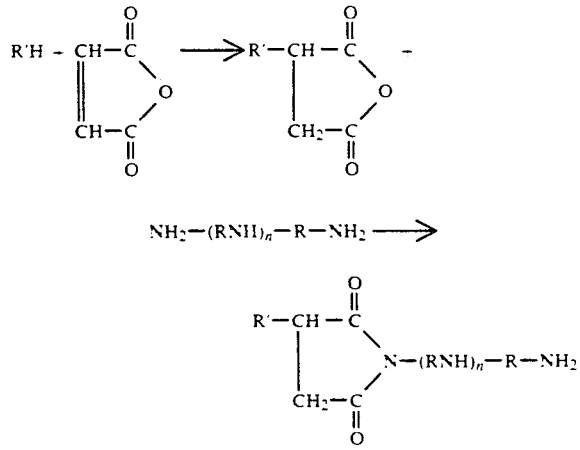

In the formula above, R' is polyalkylene containing 12 to 500 carbons, R is alkylene containing 1 to 5 carbon atoms and n is from 0 to 10.

The reaction mixture may contain from 1 mole of the anhydride per mole of the amine, or it may have an amount of anhydride equivalent to the total NH functions in the amine, i.e., up to 14 moles of anhydride per mole of amine.

Although a mono-succinimide reaction product is shown above, it is to be understood that bis-succinimide reaction products and mixtures of mono-succinimdes and bis-succinimides have utility in the practice of the present invention. As those skilled in the art would recognize, such a bis-succinimide reaction product would have the following structure:

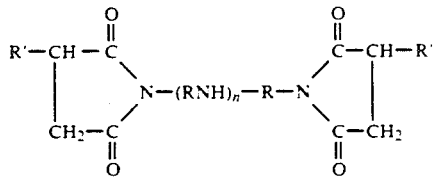

wherein, once again, R' is polyalkylene containing 12 to 500 carbons, R is alkylene containing 1 to 5 carbon atoms, and n is from 0 to 10.

The polyalkylene component of the additive composition preferably is a liquid polyalkylene where the average number of carbon atoms per molecule is between 12 and 500. Preferably the polyalkylene is a polymer of ethylene or propylene or butylene and even more preferably is polyisobutylene wherein the average number of carbon atoms per molecule is between 12 and 500.

The mineral oil can be characterized as one having a viscosity from 100 to 800 SUS at 100° F., and a minimum viscosity index of 90, more typically 91.

The three-component additive composition is formulated by mixing the components in the following broad and preferred proportions:

| | Parts by Weight | |
|---|---|---|
| | Range | Preferred Range |
| Polyalkylene succinimide | 20 to 30 | 22 to 28 |
| Polyalkylene | 35 to 55 | 40 to 50 |
| Mineral oil (100 SUS) or | 24 to 36 | 27 to 33 |
| Mineral oil (700 SUS) | 32 to 42 | 35 to 39 |

In general, the invention contemplates the use of the additive in a fuel composition in a concentration of from 80 lbs. to 400 lbs. per 1,000 barrels of fuel, and most preferably, from 120 lbs. to 250 lbs. per 1,000 barrels, the base gasoline containing less than 0.1 weight percent sulfur. Since sulfur and olefins are believed to contribute to gum formation, their reduction is advantageous in obtaining good cleanliness performance. The gasoline can also contain conventional additives such as antioxidants, metal deactivators, lead alkyls, lead scavengers, and corrosion inhibitors.

Having described the invention broadly, the following specific examples will illustrate it. It should be understood that the Examples are illustrative only and are not intended to limit the invention.

EXAMPLE 1

Premium unleaded gasoline containing various quantities of a polyisobutylene succinimide, polyalkylene, and a mineral oil mixed in the ratios shown below were evaluated in a single cylinder CLR engine using a 10 W-30 mineral oil lubricant. After 40 hours of operation at 1100 rpm and 10 to 12 inches manifold vacuum, the intake valve was removed, its combustion chamber side cleaned and the gross weight determined. Deposits were then removed mechanically and the valve's tare weight was measured in order to calculate the net weight of the deposits.

The table below presents the results for several runs with premium unleaded gasoline containing various additive package components alone and in specific combinations. As indicated, use of polyisobutylenesuccinimide alone at 50 pounds per 1000 barrels (Run B) increased ITV deposits 171% compared to Run A in which no additives were present in the fuel. The use of 60 pounds of mineral oil per 1000 barrels (Run D) also increased ITV deposits, but only slightly. Polyalkylene alone at 100 pounds per thousand barrels (Run C) did reduce intake valve deposits to 37% of Run A. However, significant further reductions in deposits were obtained when packages of the type described herein were used (Runs E and F).

TABLE I

CLR Intake Valve Cleanliness Test Results

| | Concentration, Pounds Per 1000 Barrels Of Fuel | | | | Intake Valve Deposits | |
|---|---|---|---|---|---|---|
| Pkg. | PIB-Succinimide | Poly-alkylene | 100 SUS Mineral Oil | 700 SUS Mineral Oil | Weight, Mgs. | Percent of Base |
| A | — | — | — | — | 2981 | — |
| B | 50 | — | — | — | 511 | 171 |
| C | — | 100 | — | — | 109 | 37 |
| D | — | — | 60 | — | 351 | 117 |
| E | 50 | 90 | 60 | — | 54 | 18 |
| F | 56 | 133 | — | 111 | 10 | 3 |

[1]Average of 8 runs

Premium unleaded gasoline, for example, Phillips J alone and containing additive packages C and E were evaluated in the standard CRC carburetor cleanliness test. After 20 hours of operation with the standard cycle, the tared carburetor sleeve was removed and weighed to determine the weight of deposits thereon. Table II below presents the results of several runs. Use of a polyalkylene package in C provided no carburetor keep-clean performance. The package E embodying this invention provided significant improvements in carburetor cleanliness.

TABLE II

Carburetor Cleanliness Test Results

| | Concentration, Pounds Per 1000 Barrels Of Fuel | | | Carburetor Sleeve Deposit | |
|---|---|---|---|---|---|
| Pkg. | PIB-SUCCINIMIDE | Poly Alkylene | Light Mineral Oil | Weight, Mgs. | Percent of Base |
| A | — | — | — | 24 | — |
| C | — | 100 | — | 23 | 96 |
| E | 50 | 90 | 60 | 2 | 8 |

Although the present invention has been described with preferred embodiments, it is to be understood that modifications and variations may be utilized without departing from the spirit and scope of this invention, as those skilled in the art will readily understand. Such modifications and variations are considered to be within the purview and scope of the amended claims.

What is claimed is:

1. A liquid fuel composition comprising a major amount of a liquid fuel and a minor amount of an additive composition for reducing carbon deposits in internal combustion engines comprising:

(a) a polyalkylene succinimide prepared by reacting a polyalkylenesuccinic acid or anhydride with a polyalkylene polyamine of the formula:

$$NH_2-(RNH)_n-R-NH_2$$

in which R is an alkylene radical having from 1 to 5 carbon atoms and n is from 0 to 10, said reaction product being a member of the group consisting of bis-succinimides of the structural formula:

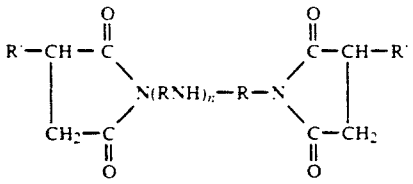

wherein R' is polyalkylene containing 12 to 500 carbon atoms, R is alkylene containing 1 to 5 carbon atoms and n is from 0 to 10, and mixtures of said bis-succinimides and mono-succinimides of the structural formula:

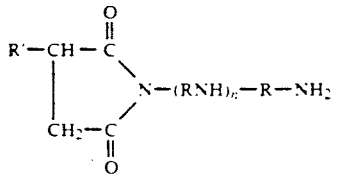

wherein R' is polyalkylene containing 12 to 500 carbon atoms, R is alkylene containing 1 to 5 carbon atoms and n is from 0 to 10;

(b) a polyalkylene; and (c) a mineral oil.

2. The liquid fuel composition of claim 1 wherein said polyalkylene succinic acid or anhydride is derived from isobutylene.

3. The liquid fuel composition of claim 1 wherein said polyalkylene succinimide is prepared from a polyamine selected from the group consisting of methylene diamine, ethylene diamine, diethylene triamine, dipropylene triamine, triethylene tetramine, tetraethylene pentamine, pentamethylene hexamine, hexaethylene heptamine, and undecaethylene dodecamine.

4. The liquid fuel composition of claim 1 wherein said polyalkylene is a liquid polyalkylene wherein the average number of carbon atoms per molecule is between about 12 and about 500.

5. The liquid fuel composition of claim 1 wherein said polyalkylene is preponderantly polyethylene or polypropylene.

6. The liquid fuel composition of claim 1 wherein said polyalkylene is polybutylene polyisobutylene.

7. The liquid fuel composition of claim 1 wherein said mineral oil has a viscosity of from about 105 to about 115 SUS at 100° F., and a minimum viscosity index of about 95.

8. The liquid fuel composition of claim 1 wherein said mineral oil has a viscosity of from about 100 to about 800 SUS at 100° F., and a minimum viscosity index of about 90.

9. The liquid fuel composition of claim 7 wherein said mineral oil has a minimum viscosity index of about 91.

10. The liquid fuel composition of claim 1 wherein said additive comprises between about 20 to about 30 parts by weight of polyalkylene succinimide, between about 35 to 55 parts of a polyalkylene, and between about 24 to about 36 parts of a mineral oil.

11. The liquid fuel composition of claim 1 wherein said additive comprises between about 22 to about 28 parts by weight of a polyalkylene succinimide, between about 40 to 50 parts of a polyalkylene, and between about 27 to about 33 parts of a mineral oil.

12. The liquid fuel composition of claim 1 wherein said additive comprises between about 20 to about 30 parts by weight of a polyalkylene succinimide, between about 35 to 55 parts of a polyalkylene, and between about 32 to about 42 parts of a mineral oil.

13. The liquid fuel composition of claim 1 wherein said liquid fuel component is selected from the group consisting of gasoline and diesel fuel.

14. The liquid fuel composition of claim 1 wherein said additive comprises between about 22 to about 28 parts by weight of a polybutylene succinimide, between about 40 to 50 parts of polybutylene, and between about 27 to about 33 parts of a mineral oil having a viscosity of from about 100 SUS to about 800 SUS at 100° F., and a minimum viscosity index of about 90 and said liquid fuel component is gasoline.

15. A method for cleaning a gasoline internal combustion engine with fuel injectors having deposits from fuel decomposition which noticeably affect performance comprising running said engine for a period of time sufficient to improve performance with a fuel containing greater than about 80 pounds per thousand barrels of an additive composition for reducing carbon deposits in internal combustion engines comprising between about 22 to about 28 parts by weight of a polyalkylene succinimide, between about 40 to 50 parts of a polyalkylene, and between about 27 to about 33 parts of a mineral oil.

16. The method of claim 15 wherein said additive comprises between about 22 to about 28 parts by weight of a polybutylene succinimide, between about 40 to about 50 parts of polybutylene, and between about 27 to about 33 parts of a mineral oil having a viscosity of from about 100 SUS to about 800 SUS at 100° F., and a minimum viscosity index of about 90 and said liquid fuel component is gasoline.

* * * * *

UNITED STATES PATENT AND TRADEMARK OFFICE

CERTIFICATE OF CORRECTION

PATENT NO. : 5,114,435

DATED : May 19, 1992

INVENTOR(S) : Guy P. Abramo and Jeffrey C. Trewella

It is certified that error appears in the above-indentified patent and that said Letters Patent is hereby corrected as shown below:

Column 5, line 53, claim 6, "polybutylene polyisobutylene" should read --preponderantly polyisobutylene--.

Signed and Sealed this

Twenty-third Day of November, 1993

*Attest:*

Bruce Lehman

BRUCE LEHMAN

*Attesting Officer*

*Commissioner of Patents and Trademarks*